United States Patent [19]

McHugh et al.

[11] 4,402,294

[45] Sep. 6, 1983

[54] FUEL INJECTION SYSTEM HAVING FUEL INJECTOR CALIBRATION

[75] Inventors: Harold R. McHugh, Kokomo, Ind.; William L. Walters, Santa Barbara, Calif.

[73] Assignee: General Motors Corporation, Detroit, Mich.

[21] Appl. No.: 343,495

[22] Filed: Jan. 28, 1982

[51] Int. Cl.[3] ..... F02B 3/00; F02B 33/00

[52] U.S. Cl. ..... 123/480; 123/494; 123/486; 123/478; 73/119 A

[58] Field of Search ..... 123/472, 486, 480, 478, 123/494, 490; 73/119 A

[56] References Cited

U.S. PATENT DOCUMENTS

| | | | |
|---|---|---|---|
| 3,575,145 | 4/1971 | Steiger | 123/458 |
| 3,587,547 | 6/1971 | Hussey | 123/472 |
| 3,835,819 | 9/1974 | Anderson | 123/486 |
| 4,366,541 | 12/1982 | Mouri | 123/480 |

*Primary Examiner*—Ronald B. Cox
*Attorney, Agent, or Firm*—Howard N. Conkey

[57] ABSTRACT

A fuel injection system for a motor vehicle internal combustion engine includes a controller that energizes an electromagnetic fuel injector for time durations determined to provide the fuel requirements of the engine. The fuel injection system is calibrated to the actual fuel flow rate of the injector by a calibration resistor provided with the injector assembly having a resistance related to the actual fuel flow rate of the injector. The controller samples the resistance of the calibration resistor and retrieves a number related to the actual fuel flow rate of the injector from a lookup table in a memory containing fuel flow rate information at locations addressed by resistance values. The retrieved fuel flow rate information is then utilized to determine the time duration required to energize the injector to obtain the required amount of fuel.

3 Claims, 4 Drawing Figures

FUEL INJECTION SYSTEM HAVING FUEL INJECTOR CALIBRATION

This invention relates to vehicle internal combustion engine fuel injection systems and more specifically to such a system that is calibrated to the fuel flow rate of the system fuel injectors.

In vehicle engine electronic fuel injection systems, a controller responds to various engine operating parameters and determines the amount of fuel to be injected into the engine to obtain a desired air/fuel ratio. The computation of the required amount of fuel is translated into a desired fuel injector energization time (injection pulse width) and a corresponding electrical signal is applied to at least one electromagnetic fuel injector. The translation from desired fuel quantity to injection pulse width is obtained by satisfying the expression Q/K where Q is the quantity of fuel to be injected and K is the design value of the injector fuel flow rate. As can be seen, if the fuel flow rate of the fuel injector deviates from the value K, the amount of fuel injected and the resulting air/fuel ratio deviate from the desired values. Typically, fuel flow rates do vary from injector-to-injector and from the design value K due primarily to manufacturing tolerances. While the fuel flow deviation from the value K may be minimized by establishing stringent manufacturing tolerances, this generally adds substantially to the cost of the fuel injectors. The provision of a mechanical adjustment for trimming the fuel flow rate of the injector to obtain the desired fuel flow rate also would add substantially to the complexity and cost of the fuel injector.

It is the general object of this invention to provide an improved internal combustion engine fuel injection system in which precise fuel metering is provided to the engine using fuel injectors having wide manufacturing tolerances.

It is another object of this invention to provide an electronic fuel injection system including a fuel injector with a calibration element representing its actual fuel flow rate and a controller sensing the element and energizing the fuel injector in accord with the fuel flow rate represented by the element to provide precise fuel metering.

It is another object of this invention to provide an electronic fuel injection system as above where the calibration element is a resistor having a resistance representing the injector fuel flow rate and the controller includes a lookup table in a memory having fuel flow rates stored in memory locations addressed by resistance values.

These and other objects of this invention may be best understood by reference to the drawings in which.

In general, this invention utilizes a fuel injector assembly that includes a resistor having a resistance value that represents the actual fuel flow rate of the fuel injector. A fuel injector control system includes a memory having locations addressed by specific resistance values and having a number stored at each memory location representing a fuel flow rate corresponding to the resistance value. The control system periodically samples the resistance value and retrieves from the lookup table the actual fuel flow rate of the injector. The injection pulse width is then based on the retrieved fuel flow rate to provide the desired amount of fuel.

Figure 2:
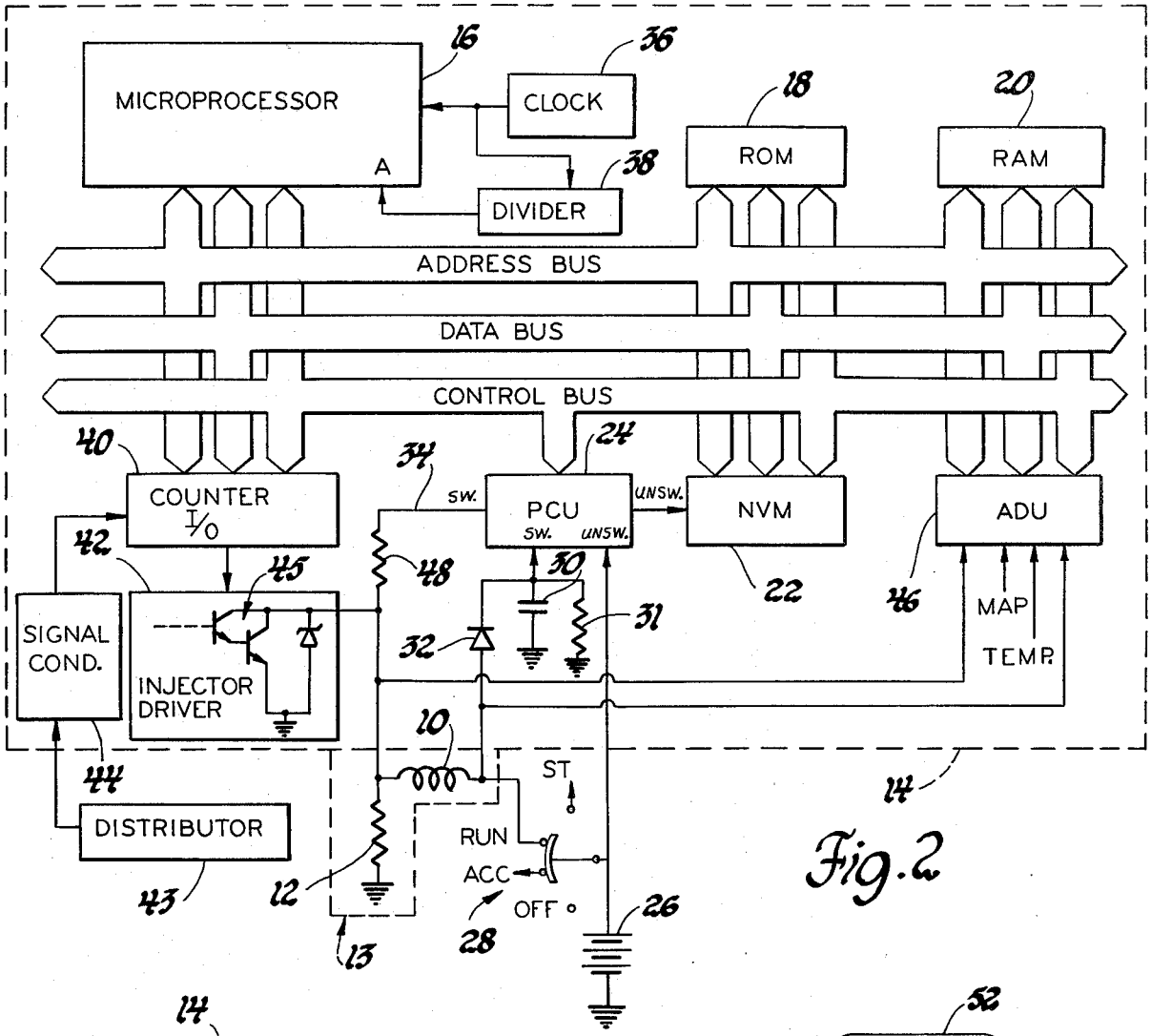
FIG. 2 illustrates a digital embodiment of the engine control module of FIG. 1.
Figure 1:
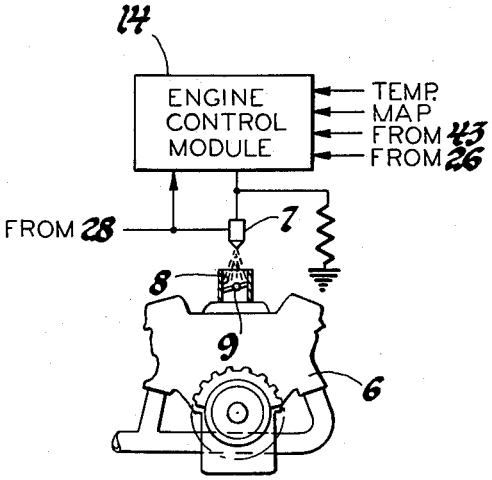
FIG. 1 illustrates a fuel injection system incorporating the fuel injection calibration principles of this invention.

Referring to FIGS. 1 and 2 there is illustrated a digital fuel injection system for metering fuel to a vehicle internal combustion engine 6. While the invention is applicable to a fuel delivery system employing more than one injector, for purposes of illustrating this invention, it is assumed that the engine 6 is supplied with fuel via a single fuel injector 7 mounted directly over the throttle bore 8 leading into the intake manifold of the engine 6. When the fuel injector 7 is opened, fuel is admitted at a substantially constant rate from a constant pressure fuel supply source (not illustrated) into the throttle bore 8 at a location above the throttle blade 9 where it is mixed with the air drawn into the intake manifold and thereafter into the combustion space of the engine. The fuel injector 7 is of the electromagnetic type that includes a winding 10 which, when energized, opens the fuel injector to supply fuel to the engine 6.

Due to factors including manufacturing tolerances, when the winding 10 is energized, the injector 7 may supply fuel at a rate deviating from a specified design value. Unless this deviation is taken into consideration, the ratio of the air and fuel mixture supplied to the engine will deviate from the desired ratio. In accord with this invention, the fuel injection system is calibrated by providing a resistor 12 with the injector assembly (generally indicated as 13 in FIG. 2) having a resistance that represents the actual fuel flow rate of the injector 7 when the winding 10 is energized. The resistor 12 may, for example, be mounted on the injector 7 or in the injector assembly harness. The calibration resistor 12 is electrically coupled between one side of the winding 10 and ground. While the value of the resistor 12 may represent the absolute fuel flow rate, in the present embodiment it represents the percent deviation (including the sign of the deviation) of the fuel flow rate from a predetermined design value K. The required resistor value may be determined after assembly of the injector 7 by supplying fuel to the injector at the proper pressure, energizing its winding and measuring its actual fuel flow rate. A resistor 12 is then selected having a resistance representing the percent and sign of the deviation of that measured fuel flow rate from the value K. This resistor is then made a part of the fuel injector assembly 13.

The injector winding 10 is energized by an engine control module (ECM) 14 for durations in accord with the values of various engine operating parameters to provide a desired ratio of the air-fuel mixture drawn into the engine 6. In this embodiment, the ECM 14 takes the form of a digital controller as illustrated in FIG. 2. The ECM 14 includes a microprocessor 16 which executes an operating program permanently stored in an external read-only memory (ROM) 18 which also contains lookup tables addressed in accord with the values of selected parameters as will be described in determining the required injection pulse width. Internal to the microprocessor 16 are conventional counters, registers, accumulators, flag flip flops, etc. Such a microprocessor may take the form of a Motorola MC-6800 Series microprocessor.

The ECM 14 also includes a random access memory (RAM) 20 into which data may be temporarily stored and from which data may be read at various address locations determined in accord with the program stored in the ROM 18. A nonvolatile memory (NVM) 22 is provided into which data or information required to be retained during periods of engine shutdown are stored. In this embodiment, the NVM 22 takes the form of a RAM that is continuously powered by an output of a power control unit (PCU) 24 that receives an unswitched voltage input from the vehicle battery 26. The PCU 24 also receives a switched voltage from the battery 24 via a conventional vehicle ignition switch 28.

When the ignition switch 28 is in the run position illustrated, the positive terminal of the vehicle battery 26 is coupled to a switched power input of the PCU 24 and across the parallel combination of a capacitor 30 and a resistor 31 through a diode 32. The PCU provides a switched regulated voltage on an output line 34 and on the system control bus during the period that an operating voltage is applied to its switched input. When the ignition switch 28 is rotated from its off position to the run position illustrated, the capacitor 30 is charged substantially instantaneously to the battery 26 voltage which is applied to the switched input of the PCU 24. When the ignition switch 28 is subsequently rotated to its off position, an operating voltage is applied to the switched input of the PCU 24 from across the capacitor 30 for a time period determined by the discharge time constant of the capacitor 30 and resistor 31. Therefore, the PCU 24 supplies a regulated voltage on the line 34 and the control bus during the time the ignition switch 28 is in the run position and for a time period after the ignition switch 28 is rotated to its off position as determined by the capacitor 30 and resistor 31. In one embodiment, the PCU 24 provides the switched regulated voltage on line 34 and the control bus for a period of 6 seconds after the ignition switch 28 is rotated to its off position.

A clock oscillator 36, which establishes the timing of the digital system, supplies a clock signal to the microprocessor 16 and to a divider 38 which issues a periodic interrupt pulse to a maskable interrupt input A of the microprocessor 16. These interrupt pulses may be spaced at, for example, 12½ millisecond intervals.

A counter input/output circuit 40 is provided having an output counter section for providing timed output pulses for energizing the fuel injector solenoid winding 10 via a driver circuit 42. In general, the counter input/output circuit 40 may include registers into which binary numbers representative of the desired injection pulse width are periodically inserted. Thereafter, the injection pulse is triggered by the output of the vehicle distributor 43 via a signal conditioner 44 which provides one pulse with each engine cylinder intake event such as by a conventional star wheel signal generator in the distributor. The injection pulse width numbers are gated into down counters by the output pulses from the vehicle distributor 43 after which the down counters are clocked by clock pulses with the output pulses of the output counter section having durations equal to the time required for the down counters to be counted down to zero. In this respect, the output pulse may be provided by a flip-flop that is set by the pulse from the distributor 43 at the time the number in the register is gated into the down counter and reset by a carry-out signal from the down counter when the number is counted to zero. Since an injection pulse is provided with each pulse output of the distributor 43, the fuel injector winding 10 is energized by the injector driver circuit 42 once with each intake stroke of the internal combustion engine. This system is of the type typically referred to as synchronous injection in which the winding 10 is energized in synchronism to engine rotation.

The injector driver circuit 42 includes an output Darlington driver transistor 45 which is biased conductive during each pulse output of the counter input/output circuit 40. When conductive, the transistor 45 completes a circuit from the positive terminal of the battery 26 through the run terminal of the ignition switch 28 and the injector winding 10 to ground to energize the winding 10 and open the fuel injector 7 to supply fuel to the engine 6. As previously indicated the rate at which the injector supplies fuel to the engine 6 is represented by the resistance of the resistor 12.

An analog-to-digital unit (ADU) 46 provides for the measurement of analog signals and the sensing of discrete (on-off) signal levels. Discrete signals are applied to discrete inputs of the ADU 46 and the various analog signals to be measured are applied to analog inputs.

While the system may utilize a plurality of discrete signal inputs, signal discrete input is illustrated that represents the on/off state of the ignition switch 28. This signal is provided from the run terminal and is at the battery 26 voltage when the ignition switch 28 is in the run position illustrated and is at a lower voltage level when the ignition switch 28 is in its off position.

Analog signals representing the conditions upon which the injection pulse widths are based are supplied to the analog inputs of the ADU 46. In the present embodiment, those signals include a manifold absolute pressure (MAP) signal provided by a conventional pressure transducer, an engine temperature signal (TEMP) to be used as a measure of cylinder intake air temperature provided by a conventional temperature transducer and a signal representing the actual fuel flow rate of the fuel injector 7 represented by the resistance of the calibration resistor 12. This last signal is provided by a voltage divider formed by the calibration resistor 12 and a resistor 48 across which the switched regulated voltage output of the PCU on line 34 is coupled. For the time period that the regulated voltage is provided by the PCU 24 at its switched output on line 34 after the ignition switch is positioned to the off position (determined by the capacitor 30 and the resistor 31), the voltage provided by the voltage divider at the junction of the calibration resistor 12 and the resistor 48 is a measure of the resistance of the calibration resistor 12 and accordingly a measure of the actual fuel flow rate of the fuel injector 7. This voltage is also sensed by the ADU as a low state of the discrete signal representing the position of the ignition switch 28.

The microprocessor 16 reads and stores the high or low states of the discrete inputs to the ADU 46 in designated memory locations in accord with the operating program stored in the ROM 18. The analog signals are each sampled and converted under the control of the microprocessor 16. The conversion process is initiated on command from the microprocessor 16 which selects the particular analog input channel to be converted. At the end of the conversion cycle, the ADU 46 generates an interrupt after which the digital data is read over the data bus on command from the microprocessor 16 and stored in ROM designated memory locations in the RAM 20 or the NVM 22.

The various elements of the engine control unit 14 are interconnected by an address bus, a data bus and a control bus. The microprocessor 16 accesses the various circuits and memory locations in the ROM 18, RAM 20 and NVM 22 via the address bus. Information is transmitted between the circuits via the data bus and the control bus includes conventional lines such as read/-write lines, reset lines, clock lines, power supply lines, etc.

The mass of air $M_A$ inducted into the engine 6 with each cylinder intake stroke can be determined from the following expression:

$$M_A = \frac{MAP \times \text{CYLINDER VOLUME}}{R \times \text{TEMP}} \quad (1)$$

where R is a gas constant.

The mass of fuel $M_F$ to be supplied to the engine with each intake stroke in order to obtain a desired air/fuel ratio can then be determined as follows:

$$M_F = \frac{M_A}{\text{AIR-FUEL RATIO}}. \quad (2)$$

Assuming the fuel injector has a design flow rate K, to provide this amount of fuel with each intake stroke, the injector winding 10 must be energized to provide an injection pulse having a duration t defined by the expression:

$$t = M_F/K. \quad (3)$$

It can be seen that if the fuel injector 7 has a fuel flow rate that deviates from the value K, the amount of fuel injected during the time period t deviates from the amount determined in equation (2). Accordingly, the air/fuel ratio of the mixture supplied to the engine 6 will deviate from the desired air/fuel ratio.

In accord with this invention, the ECM 14 adjusts the time of energization of the winding 10 in accord with the actual fuel flow rate of the injector 7 as represented by resistance of the calibration resistor 12. In this manner, the determined amount of fuel required to produce the desired air/fuel ratio is exactly provided. In general, this is provided by a lookup table in the ROM 18 having memory locations addressed by specific resistance values and having at each location the percent deviation E (including the sign of the deviation) of the actual fuel flow rate represented by the resistance value from the design value K. By sampling the resistance value of the calibration resistor 12 and determining the percent deviation E of the actual fuel flow rate of the injector 7 from the design value K, the ECM 14 can then determine the duration of the actual injection pulse required to inject the amount of fuel to produce the specified air/fuel ratio as follows:

$$t = \frac{M_F}{K(1 + .E)} \quad (4)$$

Figure 3:
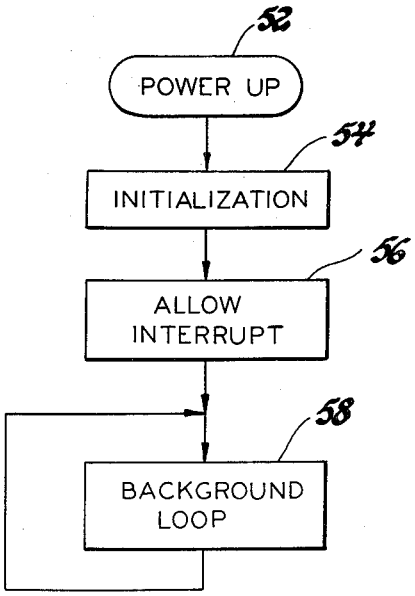
FIGS. 3 and 4 are diagrams illustrative of the operation of the digital engine control module of FIG. 2.
Figure 4:
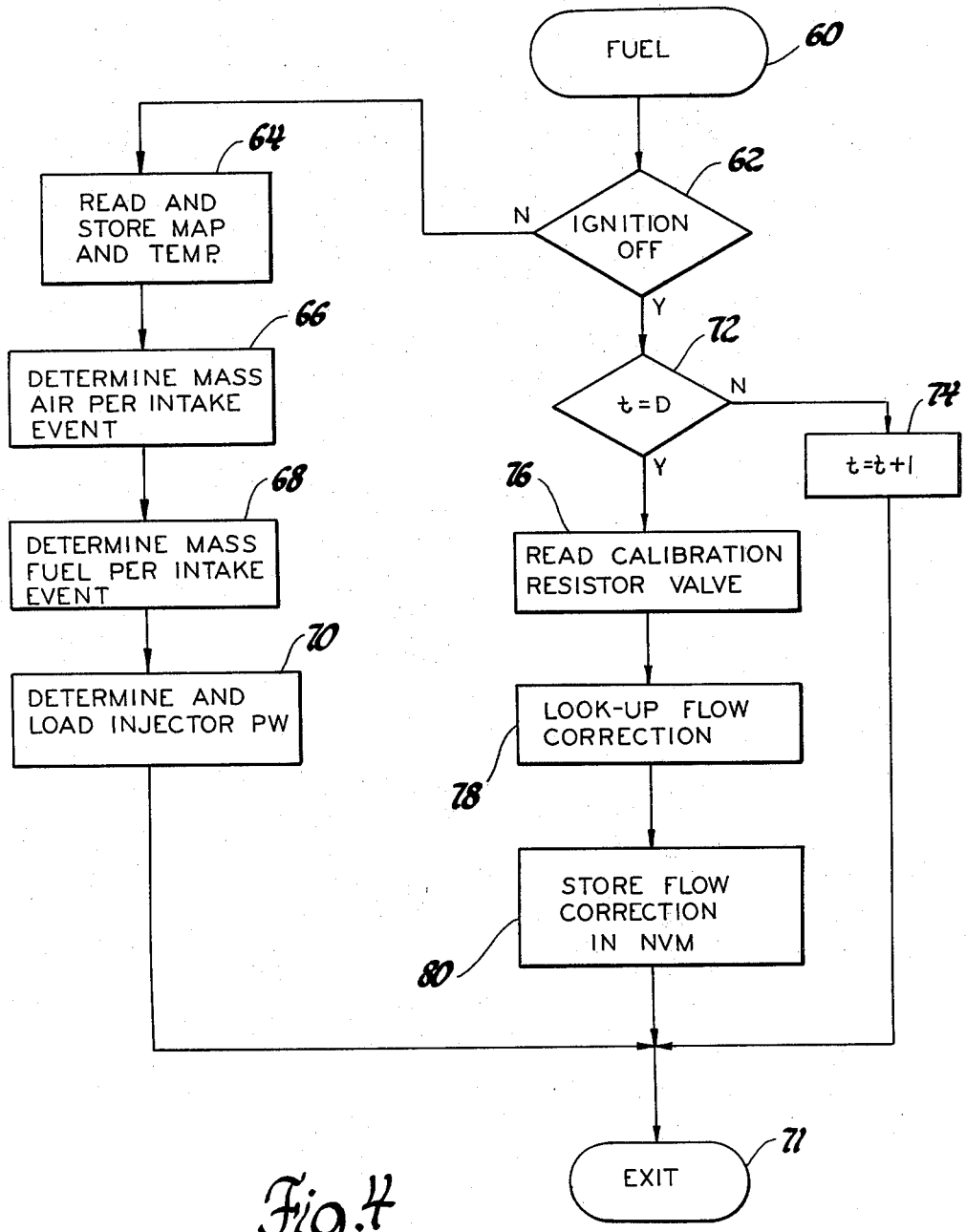

The operation of the ECM 14 in determining the injection pulse width in accord with the principles of this invention is illustrated in FIGS. 3 and 4. Referring first to FIG. 3, when power is first applied to the system by rotation of the ignition switch 28 to the position shown, the computer program is initiated at point 52 and then proceeds to a step 54 where the computer provides for system initialization. For example, at this step initial values stored in the ROM 18 are entered into ROM designated locations in the RAM 20 and counters, flags, and timers are initialized. After the initialization step 54, the program proceeds to a step 56 where the program allows interrupts to occur such as by resetting the interrupt mask bit in the microprocessor condition code register. After the step 56, the program shifts to a background loop 58 which is continuously repeated. This loop may include execution of routines such as diagnostic and warning routines.

While the system may employ numerous programs interrupts at various spaced intervals, it will be assumed for purposes of illustrating this invention that an interrupt A is provided at 12½ millisecond intervals by means of the divider 38 of FIG. 1 during which the fuel control routine for determining the injection pulse width is executed.

Referring to FIG. 4, the fuel control routine executed following each interrupt A is illustrated. The routine is entered at point 60 and proceeds to a decision point 62 where the state of the ignition switch 28 is determined. This is accomplished by sampling the discrete channel of the ADU 46 corresponding to the discrete level input from the run terminal of the ignition switch 28. If it is determined that the ignition switch is in the run position, the program proceeds to a step 64 where the program executes the analog-to-digital conversion of the MAP and TEMP values and stores the resulting digital numbers at ROM designated locations in the RAM 20. The program next proceeds to a step 66 where the mass of air $M_A$ inducted into the engine with each intake event is calculated in accord with the foregoing expression (1). Thereafter, the program proceeds to a step 68 where the mass of fuel $M_F$ required to produce the desired air/fuel ratio is calculated in accord with the foregoing expression (2). The program next proceeds to a step 70 where the duration of the injection pulse required to inject the determined amount of fuel is calculated in accord with the expression (4) and then loaded into the register in the counter input/output circuit 40.

The percent deviation used in this calculation and which represents the deviation of the actual fuel flow of the injector 7 from the design value K is obtained from the NVM 22 at a ROM designated memory location where it was previously stored during the fuel control routine as will be described. The step 70 results in a determined injection pulse width tailored to the particular fuel injector 7 supplied with the vehicle engine 6 and which produces the precise amount of fuel to obtain the desired air/fuel ratio.

Following step 70 the program exits the fuel control routine at step 71 and returns to the background loop of FIG. 3. As long as the ignition switch 28 is in the run position, the aforementioned computer steps 60 thru 70 are continually repeated at 12½ millisecond intervals. At intervals determined by the pulse output of the distributor 43, the counter I/O circuit 40 is triggered to energize the solenoid winding 10 via the driver circuit 42 for the duration determined at step 70.

When the ignition switch is rotated to the off position, battery voltage is removed from the run terminal. However, the regulated voltage from the PCU 24 on the control bus and on output line 34 is maintained for the time period determined by the discharge time constant of the capacitor 30 and the resistor 31. During this time period, the ECM 14 remains operational and the regulated voltage is applied across the voltage divider comprised of the resistor 48 and the calibration resistor 12.

During the next interrupt and when the program routine returns to the decision point 62, the off condition of the ignition switch 28 is detected and the program then proceeds to a decision point 72. At this point, the count in a timing register in the RAM 20 is compared with a constant D. This timing register was previously set to zero during the initialization step 54 of FIG. 3. If the count in this register is less than D, the program proceeds to a step 74 where the register is incremented. Thereafter, the program exits the fuel control routine at point 71. With each interrupt while the ignition is off, the program repeats the steps 72 and 74 until the timing register attains the value D which represents a predetermined elapsed time to ensure that the injector winding 10 is fully discharged so that the voltage across the resistor 12 is a true measure of its resistance.

When the timing register has been incremented to the value D, the program then proceeds from point 72 to a step 76 where the program executes a read routine to determine the resistance of resistor 12 as represented by the voltage at the junction between the resistor 48 and the calibration resistor 12. This is accomplished by commanding the ADU 46 to convert this voltage to a digital value which is read and stored in a ROM designated location in the RAM 20. This stored value represents the resistance of the calibration resistor 12. Thereafter, the program proceeds to a step 78 where the program executes a lookup routine where the lookup table in the ROM 18 containing the percent flow deviation values is addressed by the resistance value of the resistor 12 measured at step 76. The retrieved fuel flow deviation value (including the sign of the deviation) is then stored at step 80 in a ROM designated location in the NVM 22. This value stored in the NVM 22 represents the deviation in the fuel flow rate of the fuel injector 7 from the design value K. This value is then used at step 70 when the vehicle engine is next operated to determine the injection pulse width required to obtain the desired fuel quantity. In this manner, the digital fuel controller of FIG. 2 is calibrated to the actual fuel flow rate of the fuel injector 7 to thereby precisely provide fuel metering for accurate air/fuel ratio control.

The foregoing description of a preferred embodiment for purposes of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. An internal combustion engine fuel injection system including a fuel injector selected from a number of injectors having fuel flow characteristics varying from one another, the system comprising, in combination:

a calibration resistor having a value representing the actual predetermined fuel flow rate of the fuel injector;

memory means effective to store a schedule of fuel injector fuel flow rate calibration values corresponding to calibration resistor values;

means effective to measure the values of predetermined engine operating parameters indicative of engine fuel requirements;

means responsive to the values of the predetermined engine operating parameters effective to determine the fuel flow requirements for each injector energization event;

means effective to sample the value of the calibration resistor;

means effective to retrieve from the memory means the stored fuel injector fuel flow rate calibration value corresponding to the sampled value of the calibration resistor; and means effective to energize the fuel injector for a time dependent upon the retrieved fuel injector fuel flow rate calibration value to provide the determined fuel flow requirement for each energization event, whereby the calibration resistor provides for a measure of the fuel injector characteristics so that the injection amount for each injection event is independent of varying injector-to-injector fuel flow characteristics.

2. The system of claim 1 wherein the means effective to sample the value of the calibration resistor includes a voltage divider comprised of a second resistor series coupled with the calibration resistor;

means effective to apply a predetermined constant voltage across the voltage divider; and means effective to sense the voltage at the junction of the calibration and second resistors, the sensed voltage being a measure of the value of the calibration resistor.

3. An internal combustion engine fuel injection system including an electromagnetic fuel injector selected from a number of injectors having fuel flow characteristics varying from one another, the system comprising, in combination:

a calibration resistor having a resistance value representing the percent deviation of the actual predetermined fuel flow rate of the fuel injector from a design value K;

a memory having plural memory locations, each memory location being addressed by a specific resistance value and having stored thereat a corresponding percent deviation of the actual injector fuel flow rate from the value K;

means effective to measure the values of predetermined engine operating parameters indicative of engine fuel requirements;

means responsive to the values of the predetermined engine operating parameters effective to determined the fuel flow requirements $M_F$ for each injection event;

means effective to sample the resistance value of the calibration resistor;

means effective to retrieve from the memory the percent deviation stored at the memory location addressed by the sampled resistance value of the calibration resistor; and means effective to energize the fuel injector for a time equal to $$\frac{M_F}{K(1 + .E)}$$

where E is the retrieved percent deviation, whereby the calibration resistor provides for a measure of the fuel injector characteristics so that the injection amount for each injection event is independent of varying injector-to-injector fuel flow characteristics.

* * * * *

UNITED STATES PATENT AND TRADEMARK OFFICE

CERTIFICATE OF CORRECTION

PATENT NO. : 4,402,294

DATED : September 6, 1983

INVENTOR(S) : Harold R. McHugh et al

It is certified that error appears in the above—identified patent and that said Letters Patent is hereby corrected as shown below:

Column 4, line 21, the second occurrence of "signal" should read -- a single --.

Column 6, line 7, "programs" should read -- program --.

Column 8, line 47, "determined" should read -- determine --.

Signed and Sealed this

First Day of January 1985

[SEAL]

*Attest:*

*Attesting Officer*

GERALD J. MOSSINGHOFF

*Commissioner of Patents and Trademarks*